US007051485B2

(12) United States Patent
Burnette

(10) Patent No.: US 7,051,485 B2
(45) Date of Patent: May 30, 2006

(54) CEILING PANEL SYSTEM

(76) Inventor: Greg Burnette, Metal Roofing Sales, Inc., 82 Etowah River Rd., Dawsonville, GA (US) 30534

( * ) Notice: Subject to any disclaimer, the term of this patent is extended or adjusted under 35 U.S.C. 154(b) by 206 days.

(21) Appl. No.: 10/426,984

(22) Filed: Apr. 29, 2003

(65) Prior Publication Data

US 2004/0216412 A1 Nov. 4, 2004

(51) Int. Cl.
*E04C 3/00* (2006.01)
*E04C 3/30* (2006.01)

(52) U.S. Cl. ..... 52/578; 52/519; 52/535; 52/536; 52/537; 52/506.1

(58) Field of Classification Search ..... 52/578, 52/478, 520, 588.1, 580, 519, 534, 535, 542, 52/536, 537, 506.01, 506.06, 506.1, 522, 52/521; D25/119, 164, 136
See application file for complete search history.

(56) References Cited

U.S. PATENT DOCUMENTS 3,324,617 A * 6/1967 Knight et al. ..... 52/481.1
3,394,524 A 7/1968 Howarth
3,417,519 A 12/1968 Hitter
3,733,767 A 5/1973 Craik
4,009,541 A 3/1977 Yoneya
4,065,883 A 1/1978 Thibodeau
4,091,588 A * 5/1978 Heirich ..... 52/478
4,269,012 A * 5/1981 Mattingly et al. ..... 52/394
4,522,007 A * 6/1985 Oehlert ..... 52/506.1
4,817,343 A 4/1989 Rutledge
4,860,502 A 8/1989 Mickelsen
4,918,898 A * 4/1990 McLeod, Jr. ..... 52/588.1
4,936,078 A * 6/1990 Porter ..... 52/592.1
5,195,281 A 3/1993 Kosko
5,511,351 A 4/1996 Moore
5,519,974 A * 5/1996 Greenberg ..... 52/518
5,584,198 A * 12/1996 Morello et al. ..... 72/8.3

(Continued)

FOREIGN PATENT DOCUMENTS

GB 2153874 A 8/1985

OTHER PUBLICATIONS

Architectural Pricing Sheet from MBCI Metal Roof & Wall Systems Effective as of Sep. 4, 1999.

*Primary Examiner*—Carl D. Friedman
*Assistant Examiner*—Chi Q. Nguyen
(74) *Attorney, Agent, or Firm*—Joel S. Goldman, Esq.

(57) ABSTRACT

A ceiling panel system is a plurality of ceiling panels. Each ceiling panel has a first interlocking retaining bracket and an oppositely spaced second interlocking retaining bracket.

The installation of the ceiling panel system comprises: A starter bracket is connected at a right angle to one or more support beams. A first ceiling panel is connected via its second interlocking retaining bracket to the starter bracket. The first ceiling panel's first interlocking retaining bracket is connected to the beams of the supporting structure. A second ceiling panel's second interlocking retaining bracket is connected to the first ceiling panel's first interlocking retaining bracket. Subsequent ceiling panels are connected in this manner to form the ceiling panel system.

5 Claims, 6 Drawing Sheets

U.S. PATENT DOCUMENTS 5,605,022 A 2/1997 Fulton
5,673,524 A * 10/1997 Gailey ..... 52/309.9
5,855,101 A 1/1999 Schulte et al.
6,164,019 A 12/2000 Salley
6,212,837 B1 4/2001 Davis et al.
6,226,941 B1 5/2001 Stevens
6,260,316 B1 7/2001 Davis et al.
6,314,698 B1 * 11/2001 Johansson ..... 52/478
6,338,228 B1 1/2002 Chevalier
6,393,785 B1 5/2002 Burt

* cited by examiner

CEILING PANEL SYSTEM

FIELD OF THE INVENTION

The invention relates, in general, to a ceiling panel system. In particular, the invention relates to a ceiling panel system comprising a plurality of interlocking ceiling panels which may be installed at a right angle to the beams of a supporting structure as well as per pin doctoral to the beams of a supporting structure. This is accomplished by using a series of spacer brackets and suspension mounting brackets (SMBs) to which the panels will be mounted. Also, the suspension mounting brackets (SMBS) will produce angular separation (fall) from a level plane to which the panels are mounted thereby directing moisture in a selected direction.

BACKGROUND OF THE INVENTION

Historically, ceiling panel systems designed for exposure to the elements, i.e., sun, wind, rain and temperature variations, are installed under preexisting structures. Examples of pre-existing structures supporting decks, over-hanging roofs and the like. Typically, structures that support porches, decks, over-hanging roofs and the like have joists or beams that are positioned in a parallel horizontal formation to provide structural support to the associated structure. Individual ceiling panels that comprise the ceiling panel system are generally connected along the longitudinal length of a pair of parallel beams. If the beam-to-beam separation of the beams varies, a portion of the ceiling panel system is unsupported. It is not economically feasible to manufacture individual ceiling panels of different widths to compensate for the beam-to-beam separation.

Typically, ceiling panels are manufactured by rolling, extruding or bending the sidewalls of individual panels to form interlocking mechanisms that enable a plurality of ceiling panels to be formed into a ceiling panel system. If the formation of the interlocking mechanisms is by extruding a single ceiling panel, a special die or tool must be designed and built. The more angles and bends the finished interlocking mechanism has, the higher the cost of the tool and the maintenance of the tool.

Generally, a ceiling panel system installed in the traditional manner as discussed above channels moisture or condensation along the longitudinal length of the beams of the supporting structure. For structural support, porches, decks, over-hanging roofs and the like are constructed with the beams connected at a right angle to the main structure. This means, of course, channeled moisture or condensation is drained parallel to the structure. In some instances, this may not be advantageous as with the entrance or exits of buildings that have over-hanging roofs.

It would be desirable to have an interlocking ceiling panel system wherein individual ceiling panels could alternatively be mounted parallel to at right angles to the joists or beams that support the ceiling panel system. The ceiling panel system should have a minimum of angled bends for its interlocking mechanism to ease in the assembly of the ceiling system and reduce the cost of manufacture. Further, the interlocking mechanism would be interlocked in such a way as to direct moisture or condensation away from the joint. Finally, the system should be capable of being installed underneath an existing structure without requiring access form above.

SUMMARY OF THE INVENTION

The present invention is a ceiling panel system. The ceiling panel system enables installed ceiling panels to traverse the beams that support the ceiling panel system. The spacing or beam to beam separation of the supporting structure may, if desired, be random. Since the ceiling panel system may traverse the supporting beam structure the beam-to-beam separation is of no concern to the present invention in installation, where the system is installed parallel to the beams of the supporting structure.

Individual ceiling panels comprise the ceiling panel system. The individual ceiling panels are formed from a plurality of substantially rectangular ceiling portions. Each of the substantially rectangular ceiling portions has a first interlocking retaining bracket disposed along one long side and an oppositely spaced second interlocking retaining bracket disposed along the other long side. The ceiling panel system has a starter bracket that may, if desired, be installed at a right angle to the longitudinal length of the beams at one side of the supporting structure by attaching the bracket to the beams from underneath the structure. The starter bracket is connected to the second interlocking retaining bracket of the first installed ceiling panel.

The installation of the ceiling panel system progresses by connecting a first ceiling panel to the starter bracket by assembling its second interlocking retaining bracket into the starter bracket. The first ceiling panel's first interlocking retaining bracket is fastened to the beams of the supporting structure or to appropriate brackets (see below) attached to the supporting structure. A second ceiling panel's second interlocking retaining bracket is assembled to the first ceiling panel's first interlocking retaining bracket and the second panel's first bracket fastened to the support beams. Subsequent ceiling panels are connected in this manner. The ceiling panel system may include two (2) types of brackets. The first is a spacer bracket, which compensates for any space variation between the lowest point of the joint system and the lowest point of the frame structure. The second type of bracket is a suspension mounting bracket (SMB). It is important to have a level plan on which the suspension mounting brackets (SMBs) are attached.

Once the spacer brackets are in place and a level plane has been established at the lowest point of the frame structure, it is time to attach the suspension mounting brackets (SMBs). The suspension mounting brackets (SMBs) serve a two-fold purpose. First, they are the structure to which the ceiling panels will be mounted. Second, the suspension mounting brackets (SMBs) form the system that allows for the angular separation (fall) between the level plane established by the spacer brackets and the ceiling panels, which will direct moisture in a selected direction. The suspension mounting brackets (SMBs) are designed to create angular separation and increase incrementally by, for example, one-half inch (½") for each subsequent bracket. The amount of angular separation is determined by the closure between each desired amount of angular separation between each suspension mounting bracket (SMB). The greater the closure between the suspension mounting bracket (SMB), the less the angular separation. Once the desired amount of angular separation is determined, the suspension mounting brackets (SMBs) are attached to the spacer brackets at the determined intervals. Once all of the suspension mounting brackets (SMBs) are attached, it is time to mount the starter bracket.

When the installation of the present invention is complete, the ceiling panels form a plurality of channels that may direct moisture or condensation to one side and/or the other of the supporting structure rather than along the longitudinal length of the beams of the supporting structure. The channel forming ceiling panels interlock side to side via the first and second interlocking retaining brackets of individual panels and create a smooth and continuous outward appearance for the ceiling panel system appearing as a substantially flat ceiling with no visible attachment hardware from below.

When taken in conjunction with the accompanying drawings and the appended claims, other features and advantages of the present invention become apparent upon reading the following detailed description of embodiments of the invention.

BRIEF DESCRIPTION OF THE DRAWINGS

The invention is illustrated in the drawings in which like reference characters designate the same or similar parts throughout the figures of which.

DETAILED DESCRIPTION

Figure 1:
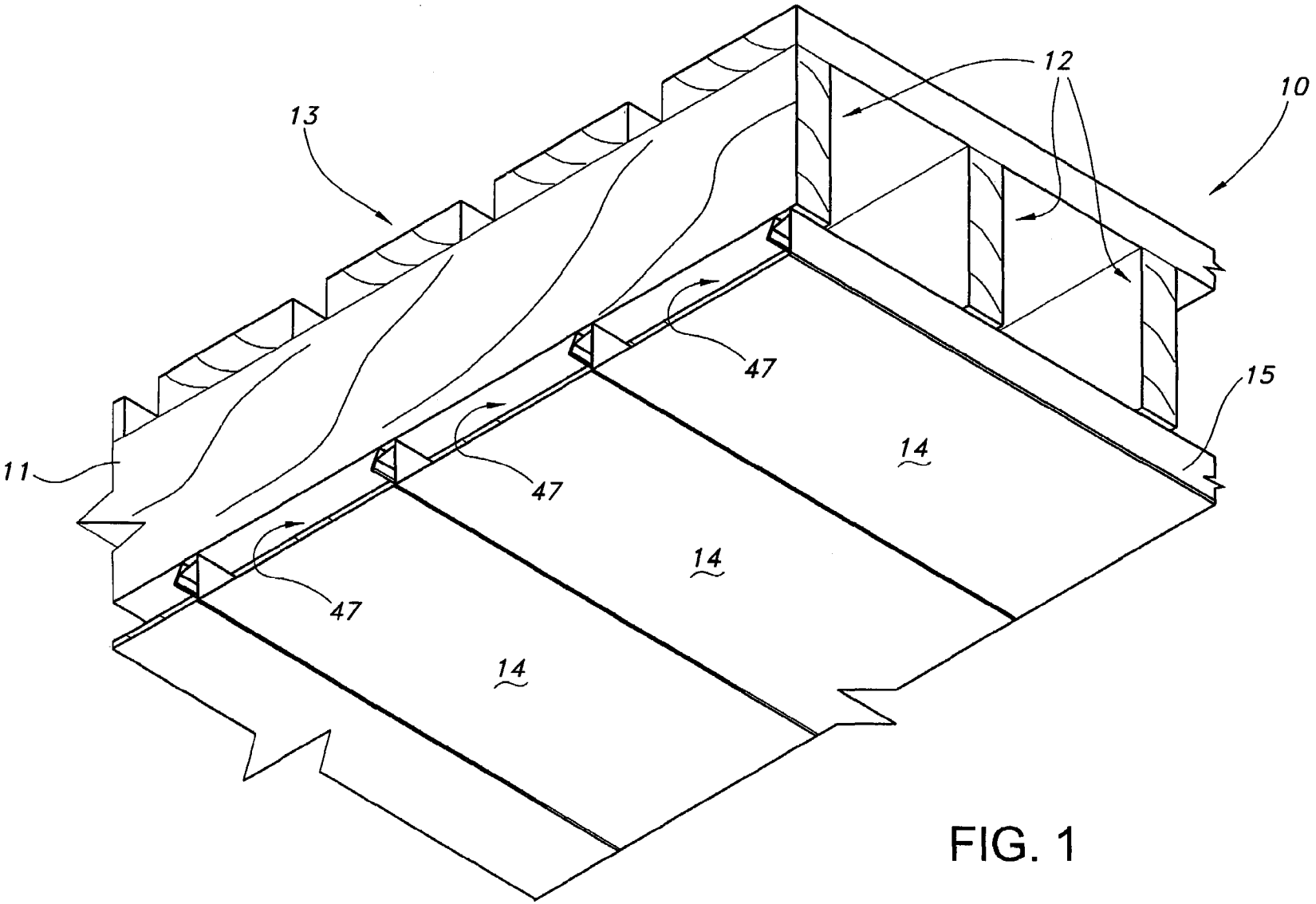
FIG. 1 illustrates a perspective view diagram of the present invention.

The present invention 10, FIG. 1 is a ceiling panel system that is installed on any type of ceiling structure that may be exposed to the elements, i.e., sun, wind, rain and temperature variations. Examples of ceiling structures are porches, decks, over-hanging roofs and the like. Typically, structures supporting porches, decks, over-hanging roofs and the like have joists or beams 11 that are positioned in a parallel horizontal formation 12 to provide the structural support to the associated structure 13, i.e., deck floor boards. The present invention 10 may, if desired, be installed at a right angle to the parallel horizontal formation 12 of the beams 11. This positional arrangement enables the present invention 10 to traverse the parallel horizontal formation 12 of the beams 11 without concern for the distance of beam-to-beam separation. When fully installed to a desired structure the present invention 10 forms channels 47 that drain condensation or rainwater away from the entire area below the structure. Further, when fully installed to a desired structure, the ceiling formed by the present invention 10 projects a smooth outer surface 14 that may, if desired, be covered with any type of finish. Examples of finishes are paint, epoxy, anodize or any other decorative or protective covering.

Figure 2:
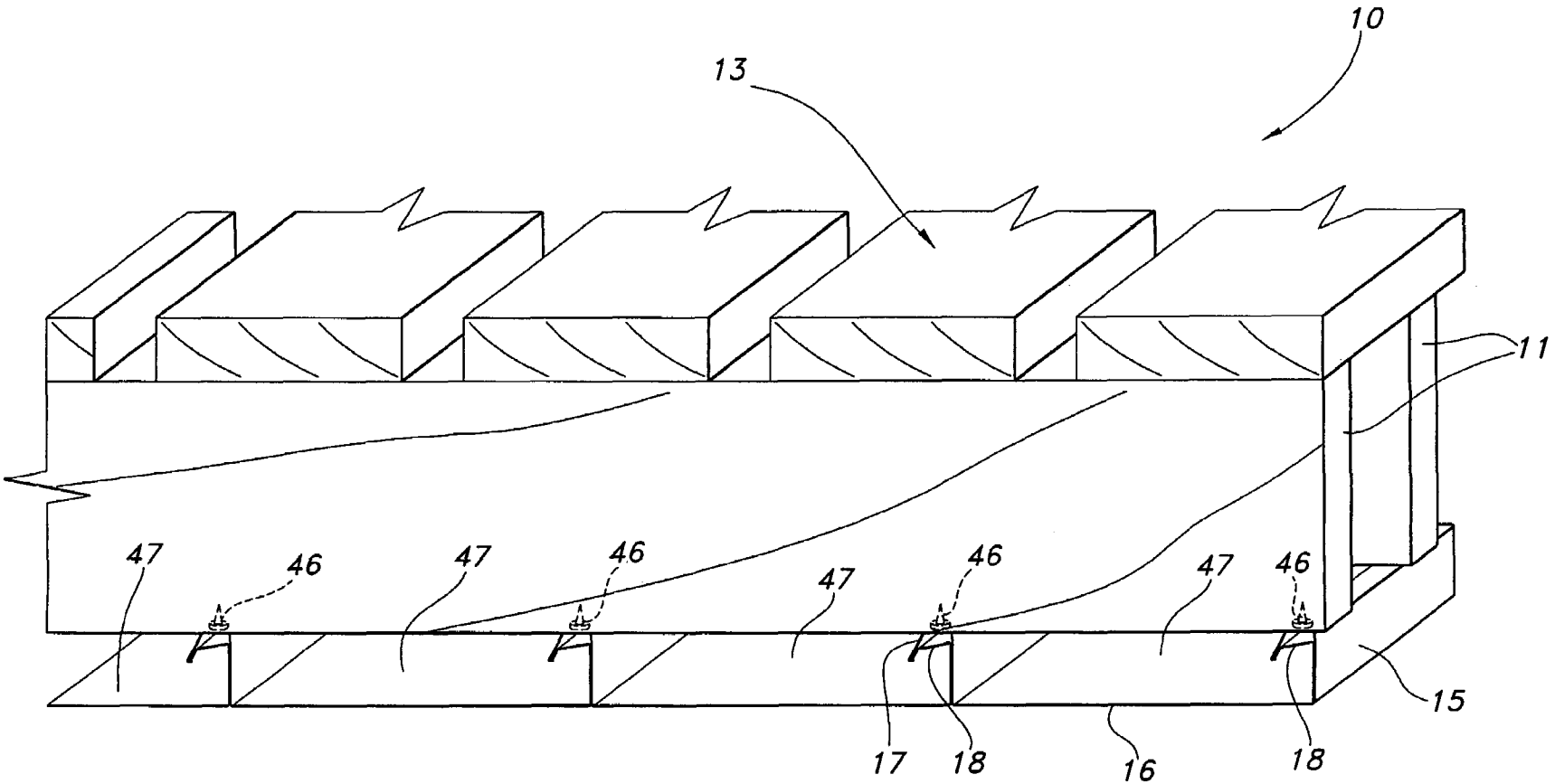
FIG. 2 illustrates a side view diagram of the present invention of FIG. 1, FIG. 3 Illustrates a side view diagram of a second interlocking retaining bracket detachably secured within the confines of a first interlocking retaining bracket of FIG. 1.

The installation of the present invention 10, FIG. 2 is a two-step process. An elongated starter bracket 15 may be positioned along or preferably at a right angle to the parallel horizontal formation 12 of the beams 11. The starter bracket 15 may, if desired, traverse a selected portion of the parallel horizontal formation 12 of the beams 11. The starter bracket 15 may be attached at one end of each or selected ones of support beams 11. The starter bracket 15 is connected or secured to at least one beam 11 by fastening means 46 and may, if desired, be connected to a plurality of the beams 11. A retaining portion 50 of the starter bracket 15 (See FIG. 6) is sized to receive a second interlocking bracket 18 of an individual ceiling panel 16 (discussed herein).

The second step of the installation of the present invention 10, FIG. 2 is positioning a ceiling panel 16, along the starter bracket 15. The ceiling panel 16, FIG. 5 has a first interlocking retaining bracket 17 formed along one long side of the ceiling panel 16. A second interlocking bracket 18, oppositely spaced from the first interlocking retaining bracket 17, is formed along the other long side of ceiling panel 16. The second interlocking bracket 18 is detachably secured to the starter bracket 15, by, in the illustrative embodiments, force fitting the bracket 18 into the retaining portion 50 of the starter bracket 15. This serves to connect the ceiling panel 16 to the starter bracket 15 and also to cover and hide from view the mounting means 46 of bracket 15. The first interlocking retaining bracket 17 of panel 16 is connected to at least one or more beams 11 by fastening means 42. Ceiling panel 16 is now positioned to receive the second interlocking retaining bracket 18 from a second or subsequent ceiling panel 16 wherein the second interlocking bracket 18 is detachably secured to the first interlocking retaining bracket 17 of the first ceiling panel 16. The process of alternately connecting the first interlocking bracket 17 of one ceiling panel 16 to the beams 11 and the second interlocking retaining bracket 18 of the next ceiling panel to the first attached interlocking retaining bracket 17 of the previous ceiling panel continues until the desired ceiling structure is complete.

Figure 6:
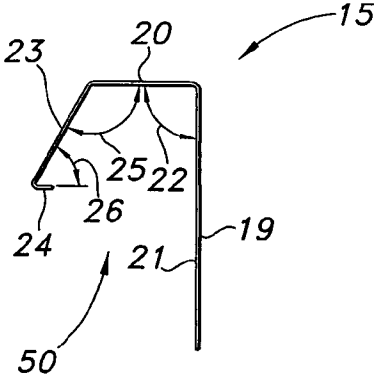
FIG. 6 illustrates a side view diagram of a starter bracket of FIG. 1.

The starter bracket 15, FIG. 6 includes a vertical wall 19 that may, if desired, have a flat inside surface 21. The bracket 15 also includes a top extending from the top of the vertical wall 19 at a right angle 27 to the top surface 21. An outwardly extending flange 23 extends from the top portion 20 at an oblique angle 25. An inwardly extending member 24 extends along to open the end of the outwardly extending flange 23 at an acute angle 26. The oblique angle 25 is defined as an angle that is neither a right angle nor a multiple of a right angle. The acute angle 26 is defined as an angle that is less than or equal to 180 degrees minus the oblique angle 25 (acute angle 26 180 degrees−oblique angle 25).

The starter bracket 15, FIG. 6 may, if desired, be connected to the parallel horizontal formation structure 12 of beams 11 by any convenient means known in the art, such as screws, bolts, nails, staples, etc. The forming of the starter bracket 15 may, if desired, be from any convenient manufacturing techniques or processes. Examples of manufacturing techniques applied to forming the starter bracket 15 are bending, rolling, stamping and/or casting of metal or molding or extruding of plastic materials.

Figure 5:
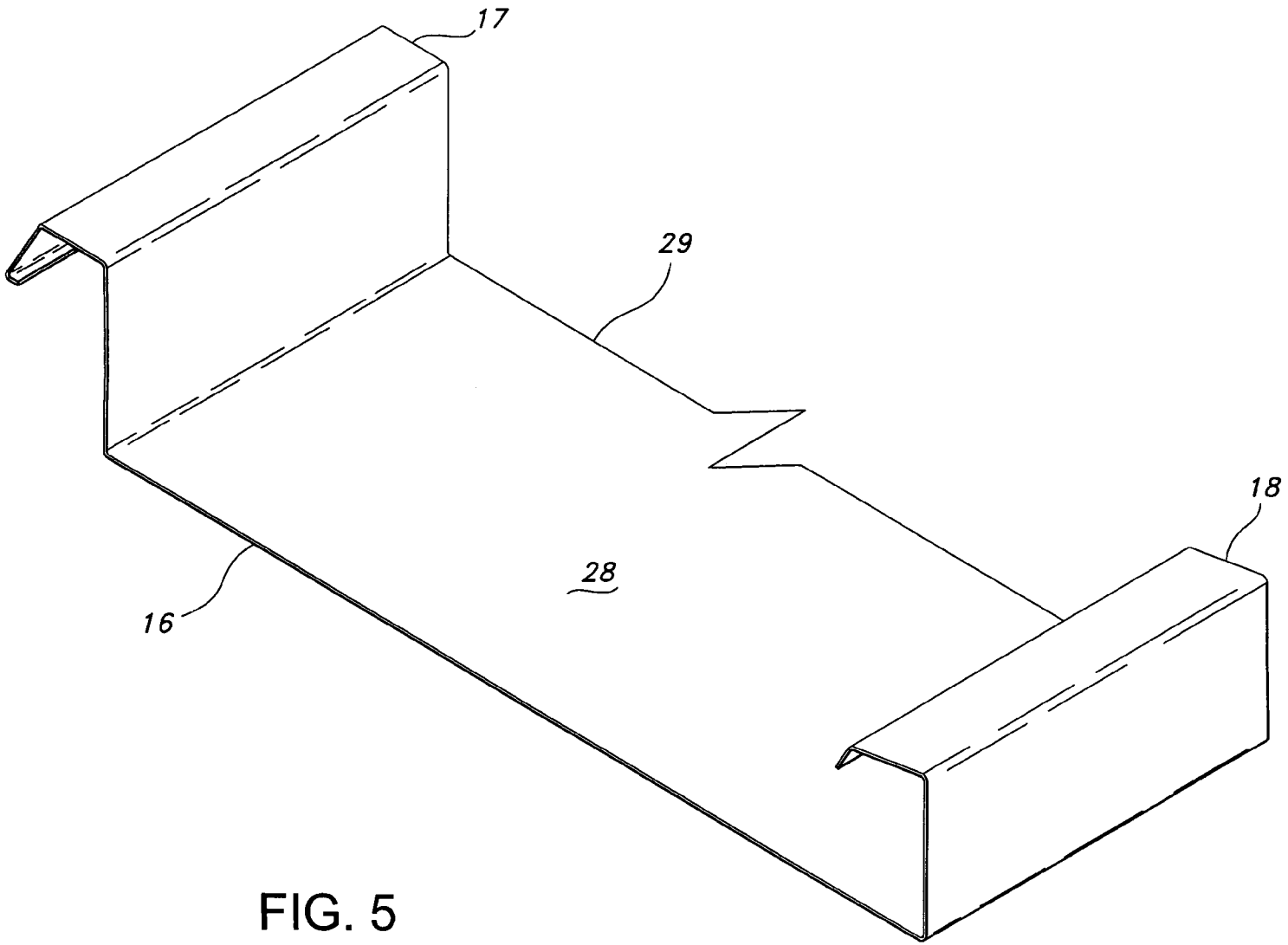
FIG. 5 illustrates a perspective view diagram of the ceiling panel of FIG. 4.

The ceiling panel 16, FIG. 5, is formed as a ceiling portion 29 which has extending from it two oppositely spaced interlocking retaining brackets 17 and 18. The first interlocking retaining bracket 17 is facing outward facing with respect to the top of the surface 28 of the ceiling portion 29. The second interlocking retaining bracket 18 is faced inward with respect to the top surface 28 of the ceiling portion 29.

Figure 4:
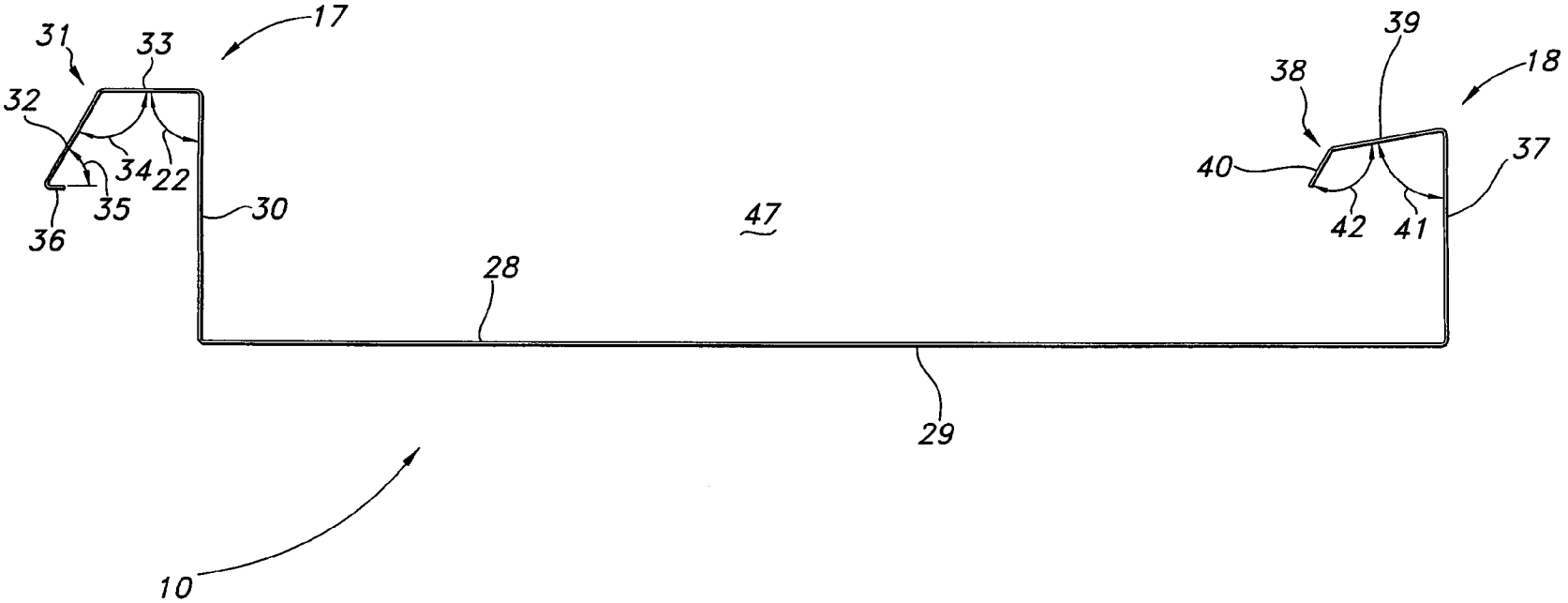
FIG. 4 illustrates a side view diagram of a ceiling panel of FIG. 1.

The first interlocking retaining bracket 17, FIG. 4 may, if desired, include a vertical wall 30 extending from one side of the ceiling portion 29. The vertical wall 30 is formed at a right angle to the top surface 28 of the ceiling portion 29. The top of the vertical wall 30 extends into an outwardly extending flange 31. The outwardly extending flange 31 is formed at a right angle 22 with respect to the vertical wall 30. The outwardly extending flange 31 has an upper portion 33 and an lower portion 32. The lower portion 32 is formed at an oblique angle with respect to the upper portion 33. The oblique angle 34 is defined as an angle that is neither a right angle nor a multiple of a right angle. The end portion of the lower portion 32 is formed into an inwardly extending member 36. The inwardly extending member 36 is formed at an acute angle 35 with respect to the lower portion 32. The acute angle 35 is defined as an angle that is less than or equal to 180 degrees minus the oblique angle 34 (acute angle 35 180 degrees–oblique angle 34). It will be noted that the angular relationship between the respective portions of the first bracket 17 of the ceiling panel and the respective portions of the starter bracket 15 are substantially the same or similar.

The second interlocking retaining bracket 18, FIG. 4 may, if desired, include from a vertical wall 37 extending from the opposite ceiling portion 29 opposite to the first interlocking retaining bracket 17. The vertical wall 37 is formed at a right angle to the top surface 28 of the ceiling portion 29. The upper end of the vertical wall 37 extends into an inwardly extending flange 38. The inwardly extending flange 38 is formed at an acute angle 41 with respect to the first portion 37. The inwardly extending flange 38 has a upper portion 39 and an lower portion 40. The lower portion 40 is formed at an oblique angle 42 with respect to the upper portion 39. The oblique angle 42 is defined as an angle that is neither a right angle nor a multiple of a right angle. The acute angle 41 is defined as an angle that is less than or equal to 180 degrees minus the oblique angle 42 (acute angle 41 180 degrees–oblique angle 42).

Figure 3:
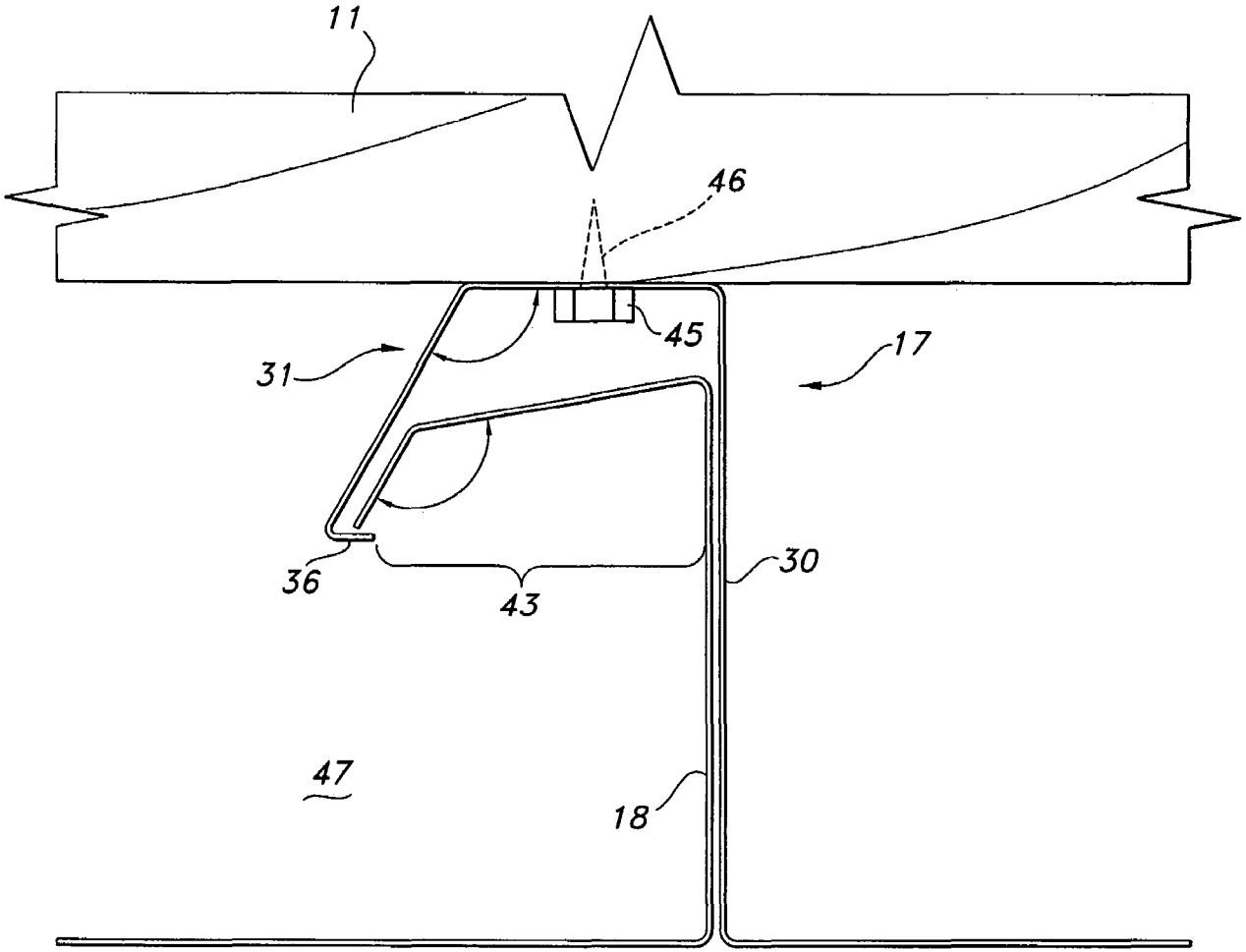

Referring to FIG. 3, the first interlocking retaining bracket's 17, FIG. 3 vertical wall 30 and outwardly extending flange 31 form walls about an opening 43. The opening 43 of the first interlocking retaining bracket 17 is sized to receive the second interlocking retaining bracket of a second or subsequent ceiling panel 16 via the opening 43. Once the second interlocking retaining bracket 18 is within the confines of the interior walls of the first interlocking retaining bracket 17, it is detachably secured by the inwardly extending member 36.

A shim 45, FIG. 3 may, if desired, be inserted between the support beams 11 and the first interlocking retaining bracket 17 of one ceiling panel 16 and/or the starter bracket 15. The shim 45 secures the first interlocking retaining bracket 17 and/or the starter bracket 15 to at least one beam 11 of the parallel horizontal formation 12 of beams 11 via a fastening device 46. Preferably, the shim 45 secures a plurality of first interlocking retaining brackets 17 to a plurality of beams 11 of the parallel horizontal formation 12. The shim 45 may, if desired, be an elongated strip formed into any convenient geometric shape. For example, the shim 45 is substantially rectangular and is fabricated from an elastic material. Further, the shim 45 may, if desired, be formed into an individual structure of any convenient geometric shape with the fastening devices integral or separate to the structure. For example, shim 45 is formed from a rounded cushioning material with a fastening means (i.e., a nail or screw) inserted there-through to fasten the shim 45 to the first interlocking retaining bracket 17 or the starter bracket 15 to at least one beam 11. The channel 47 is defined by the vertical walls formed between the first and second interlocking retaining brackets 17 and 18 of the ceiling panel 16 by use of shims 45 or other suitable spacing means. The installed plurality of ceiling panels 16 may, if desired, be sloped or angled to direct the volume of moisture or condensation away from any underlying structure. For example, the plurality of ceiling panels 16 are installed under an existing deck as discussed herein. The ceiling panels 16 are angled to one end of the deck; therefore, any moisture accumulating in the channel 47 is directed to the end of the deck and not to any structure directly under the deck.

Figure 7:
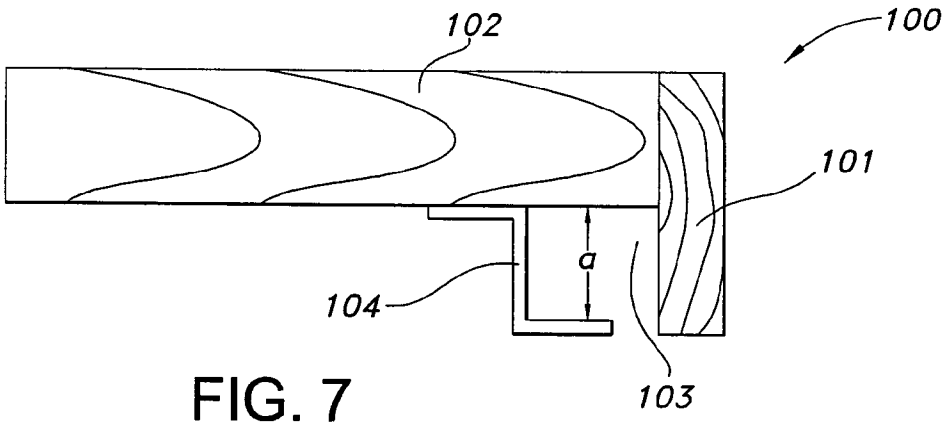
FIG. 7 illustrates a side view of a spacer bracket of the present invention.
Figure 9:
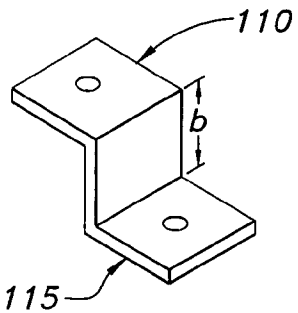
FIG. 9 illustrates a suspension mounting bracket (SMB) of the present invention.
Figure 8:
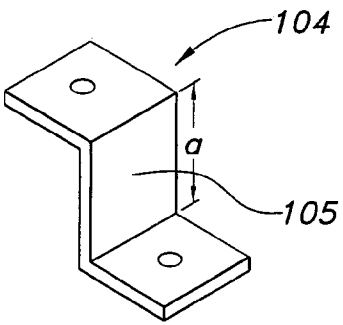
FIG. 8 illustrates a spacer bracket of the present invention installed on the supporting structure.

Referring now to FIG. 7, FIG. 8 and FIG. 9, there is shown a presently-preferred method for installing the ceiling panel system of the present invention.

FIG. 7 illustrates a structure 100, such as a deck attached to a residential structure. Typically, such a deck is formed of framing beams 101 along the outside of the deck and structural beams, or joists 102, perpendicular to one (1) pair of framing beams 101. Typically, the joists 102 are set at sixteen inch (16") centers. A typical framing beam 101 may be a two foot by ten inch (2'×10") wooden board. A structural beam, or joist, is typically somewhat smaller, e.g., a two foot by eight inch (2'×8") wooden board of convenient length. Thus, a gap 103 is between the bottom of the structural beam, or joist, and the bottom of the framing beams. This gap 103 has a length (a).

In order to ensure that the ceiling panel system fits below the framing beams, a spacer bracket 104 (See FIG. 8) is provided, having a vertical dimension 105 equal to the length of the gap 103.

A plurality of these brackets 104 are installed in rows on the bottom side of the joist 101, these rows being approximately three feet (3') apart. Closer spacing may be used for additional structural integrity, or further spacing may be used to save installation time. These rows may run parallel or perpendicular to the joists 102, or arranged along joints 102 in this arrangement, for a four foot (4') spacing between rows of brackets 104. The brackets would be installed on every third (3rd) beam 102, assuming the beams were installed at standard sixteen inch (16") centers. When the rows of space brackets 104 are completely installed, a row of suspension mounting brackets 10 (see FIG. 9), are attached to each of the space brackets 104 by suitable means, such as nut and bolt, rivet, etc. The spacing brackets come in various vertical dimensions (b), ranging from approximately one inch (1") in one-half inch (½") increments to a bracket having a dimension of 1+(R−1)×½", where R is the number of rows of space brackets.

A plurality of the shortest types of suspension brackets are attached to a first row of space brackets nearest to one (1) of the framing beams 101. A second plurality of suspension mounting brackets 110 having the next larger dimension (i.e., one and one-half inches (1½")) is attached to the corresponding space brackets 104 in the next adjoining row, and so forth.

When this process is completed, the ceiling panels may be attached to the bottom portions 115 of the suspension mounting brackets 110 as described previously. The resulting structure is tilted to allow water to run off the lowest hanging side of the structure.

Figure 10:
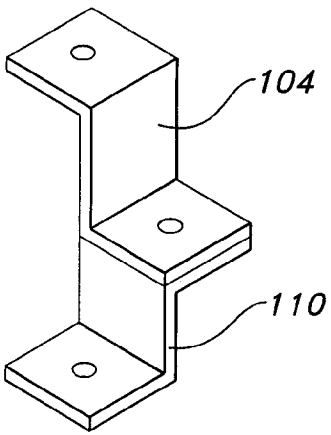
FIG. 10 illustrates a connection between a spacer bracket and a suspension mounting bracket of the invention

A more detailed view of a typical connection between a spacer bracket 104 and a suspension mounting bracket 110 is shown in FIG. 10.

The forming of the ceiling panel's 16 first and second interlocking retaining bracket 17 and 18, respectively may, if desired, be from any convenient manufacturing techniques or processes. Examples of manufacturing techniques applied to forming the first and second interlocking retaining bracket

17 and 18 are bending, rolling, stamping and/or casting of metal or extruding or molding plastic materials.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together whereas a screw employs a helical surface, in the environment of fastening wooden parts, a nail and a screw may be equivalent structures.

What is claimed is:

1. A ceiling panel system installable to supporting beams from beneath, comprising a plurality of ceiling panels each having:

a) a ceiling portion having a top surface;

b) a first interlocking retaining bracket formed along one long side of the ceiling portion, consisting of;

(i) a vertical wall extending at a right angle from the top surface of the ceiling portion;

(ii) a top portion extending from the vertical wall of the top portion at a right angle;

(iii) an outwardly extending flange extending from the top portion at an oblique angle; and (iv) an inwardly extending member extending from the lower portion of said outwardly extending flange at an acute angle;

c) a second interlocking retaining bracket formed along a side of said ceiling portion opposite said first bracket, consisting of;

(i) a vertical wall extending at a right angle to said top surface of the ceiling portion;

(ii) an inwardly extending flange extending from said vertical wall at an acute angle;

(iii) an outwardly extending member extending from said inwardly extending flange at an oblique angle;

d) said first interlocking retaining bracket of a first ceiling panel being detachably securable to a second interlocking retaining bracket of a second ceiling panel.

2. A ceiling panel system as recited in claim 1, further comprising a starter bracket, consisting of:

a) an elongated top portion;

b) a vertical wall extending at a right angle from a first edge portion of the top portion of the elongated top portion;

c) an outwardly extending member extending at an oblique angle from an edge portion of said elongated top portion opposite said first edge portion; and d) an inwardly extending member extending from said outwardly extending member at an acute angle.

3. A ceiling panel system as recited in claim 1, wherein said acute angle is less than 180 degrees (180°) minus said oblique angle.

4. A ceiling panel system as recited in claim 1, wherein said first interlocking retaining bracket, said second interlocking retaining bracket and said top surface form a channel extending the longitudinal length of said ceiling portion.

5. A ceiling panel system as recited in claim 4, wherein said channel captures moisture therein, said channel directing the moisture along the ceiling panel system.

* * * * *